US011289851B2

(12) United States Patent
Truong

(10) Patent No.: US 11,289,851 B2
(45) Date of Patent: Mar. 29, 2022

(54) CONNECTOR STRUCTURE WITH PULL TAP

(71) Applicant: JESS-LINK PRODUCTS CO., LTD., New Taipei (TW)

(72) Inventor: Thanh-An Truong, New Taipei (TW)

(73) Assignee: JESS-LINK PRODUCTS CO., LTD., New Taipei (TW)

( * ) Notice: Subject to any disclaimer, the term of this patent is extended or adjusted under 35 U.S.C. 154(b) by 0 days.

(21) Appl. No.: 17/159,018

(22) Filed: Jan. 26, 2021

(65) Prior Publication Data

US 2021/0249816 A1 Aug. 12, 2021

(30) Foreign Application Priority Data

Feb. 6, 2020 (TW) ..... 109201310

(51) Int. Cl.
*H01R 13/633* (2006.01)
*H01R 13/631* (2006.01)
*H01R 13/627* (2006.01)

(52) U.S. Cl.
CPC ..... *H01R 13/6335* (2013.01); *H01R 13/6272* (2013.01); *H01R 13/631* (2013.01)

(58) Field of Classification Search
CPC ..... H01R 13/6272; H01R 13/6275; H01R 13/6335; H01R 13/631
USPC ..... 439/352
See application file for complete search history.

(56) References Cited

U.S. PATENT DOCUMENTS 7,189,098 B1 * 3/2007 Wu ..... H01R 13/405 439/352
7,828,579 B2 * 11/2010 Huang ..... H01R 13/6275 439/352
8,475,199 B2 * 7/2013 Wang ..... H01R 13/6275 439/353
8,562,369 B2 * 10/2013 Wu ..... H01R 13/6471 439/345
8,905,777 B2 * 12/2014 Zhu ..... H01R 13/62 439/352
8,986,036 B2 * 3/2015 Lindkamp ..... G02B 6/4246 439/352
2014/0235091 A1 * 8/2014 Wang ..... H01R 13/6275 439/352

* cited by examiner

*Primary Examiner* — Gary F Paumen

(57) ABSTRACT

A connector structure with pull tap includes a plug, a latch and a pull tap. The plug includes a main body and a protruding structure. The protruding structure is extended outward from the main body and includes a groove. The latch includes a fixed arm and an elastic arm. The fixed arm has an installing structure and an opening, and the installing structure is connected to the groove of the protruding structure. The elastic arm is extended from the fixed arm and hangs above the fixed arm. The pull tap includes a tap body and a first end located at one end of the tap body. The pull tap passes through the opening of the fixed arm and the elastic arm is arranged on the first end to fix the first end on the elastic arm.

10 Claims, 10 Drawing Sheets

CONNECTOR STRUCTURE WITH PULL TAP

BACKGROUND OF THE INVENTION

1. Field of the Invention

The present invention relates to a connector structure, more specifically, relates to a connector structure with a pull tap.

2. Description of the Prior Art

Connectors are connecting components and accessories for electrical signals, and the electronic devices translate and transmit the signal to each other through the cables and connectors. That is to say, the connectors are the communicating bridges for the signals. The connectors are widely applied to cars and computer peripheral and communicating data applications, industries, military and aerospace industry, transportation, consumer electronics, medical treatments, instruments, commercial equipment and so on. Therefore, the connectors play an important role in many fields.

In general, the plug and socket of the electronic product are connected in a butt-connected manner. The plug is usually provided with a latch to engage the locking structure of the socket, thereby preventing the plug and socket from being separated from each other. When the plug and socket of the connector need to be disassembled, the user separates the latch from the locking structure by pressing the latch. In order to conveniently disassemble the connector, a space above the connector must be reserved for the user's fingers to press the latch.

However, along with the development of the electronics industry, the tendency is to miniaturize the electronic products; therefore, the distance among the electronic components in the circuit board of the electronic product is getting smaller. If the arrangement of the connector and other electronic components is too compact, it is difficult for the user to press the latch to separate the connectors from each other, thereby reducing installation efficiency and increasing installation times, and even causing damage to other electronic components. In addition, if the design of the circuit board reserves the pressing space of the connector, the size of the circuit board will increase, and it is not conducive to the development and application of miniaturization and light weight of electronic products, thereby increasing the costs.

SUMMARY OF THE INVENTION

Therefore, the present invention provides a connector structure with pull tap to solve the problems of the prior art.

In one embodiment of the present invention, the connector structure with pull tap includes a plug, a latch and a pull tap. The plug includes a main body and a protruding structure. The protruding structure extends outward from the main body and includes a groove. The latch is configured on the plug. The latch further includes a fixed arm and an elastic arm. The fixed arm has an installing structure matching the groove and an opening. The installing structure is pivotally connected to the groove of the protruding structure. The elastic arm extends from the fixed arm and hangs above the fixed arm. The pull tap is assembled on the latch. The pull tap includes a tap body and a first end located at one end of the tap body. The pull tap passes through the opening of the fixed arm and the elastic arm is arranged on the first end to fix the first end on the elastic arm.

Wherein, the protruding structure includes a first protruding structure and a second protruding structure. The first protruding structure and the second protruding structure include a first groove and a second groove respectively. The first groove and the second groove are opposite to each other and configured at two opposite sides of the installing structure respectively. The installing structure is embedded to the first groove and the second groove when the latch is configured on the plug.

Wherein, the elastic arm includes a fixed hole. The first end of the pull tap includes a tap head and a neck portion, and the tap body includes a flexible structure. The size of the tap head is larger than that of the fixed hole, and the neck portion is located between the tap head and the flexible structure. The fixed hole is arranged on the neck portion and the tap head, and the flexible structure is located at two opposite sides of the elastic arm respectively after the pull tap is assembled on the latch.

Wherein, the tap body includes a second end opposite to the first end. When the pull tap is assembled on the latch, the second end of the tap body passes through the fixed hole of the elastic arm and the opening of the fixed arm in sequence to attach the tap head on one side of the elastic arm.

Wherein, the elastic arm includes a first fixed hole and a second fixed hole. The first end of the tap body includes a tap head and a neck portion. The tap body includes a first flexible structure, and the tap head includes a second flexible structure. The size of the tap head is greater than that of the fixed hole, and the neck portion is located between the tap head and the flexible structure. When the pull tap is assembled on the latch, the first fixed hole is arranged on the neck portion, the second fixed hole is arranged on the second flexible structure, and the tap head and the first flexible structure are located at two opposite sides of the installing structure respectively.

Wherein, the elastic arm includes a hook structure, and the first end of the tap body includes a tap head matching the hook structure. When the pull tap is assembled on the latch, the tap head passes through the opening of the fixed arm and hooks the hook structure.

Wherein, the fixed arm includes a guiding structure. The guiding structure is located above the opening of the fixed arm.

Furthermore, the elastic arm of the latch includes a lock structure. The lock structure is configured to joint a lock opening of a socket matching the lock structure.

Wherein, the elastic arm of the latch has a press portion configured to be pressed. When the press portion is pressed, the elastic arm is deformed to separate the lock structure from the lock opening.

Furthermore, the tap body includes a second end opposite to the first end and has a bend portion. The bend portion has a bending surface. When the second end is pulled, the bend portion contacts the guiding structure and moves along the bending surface to press the press portion of the elastic arm by the first end of the pull tap.

In summary, the connector structure with pull tap of the present invention strengthens the structures between the latch and the plug through the fixed arm of the latch and the protruding structure of the plug, so that the latch is not easily to shake or bend, thereby increasing efficiency and durability. Moreover, the connector structure of the present invention guides the moving direction of the pull tap by the guiding structure of the latch instead of the connector body, to avoid the abrasion of the connector body caused by multiple pulls of the pull tap, thereby reducing costs.

BRIEF DESCRIPTION OF THE APPENDED DRAWINGS

DETAILED DESCRIPTION OF THE INVENTION

Figure 1:
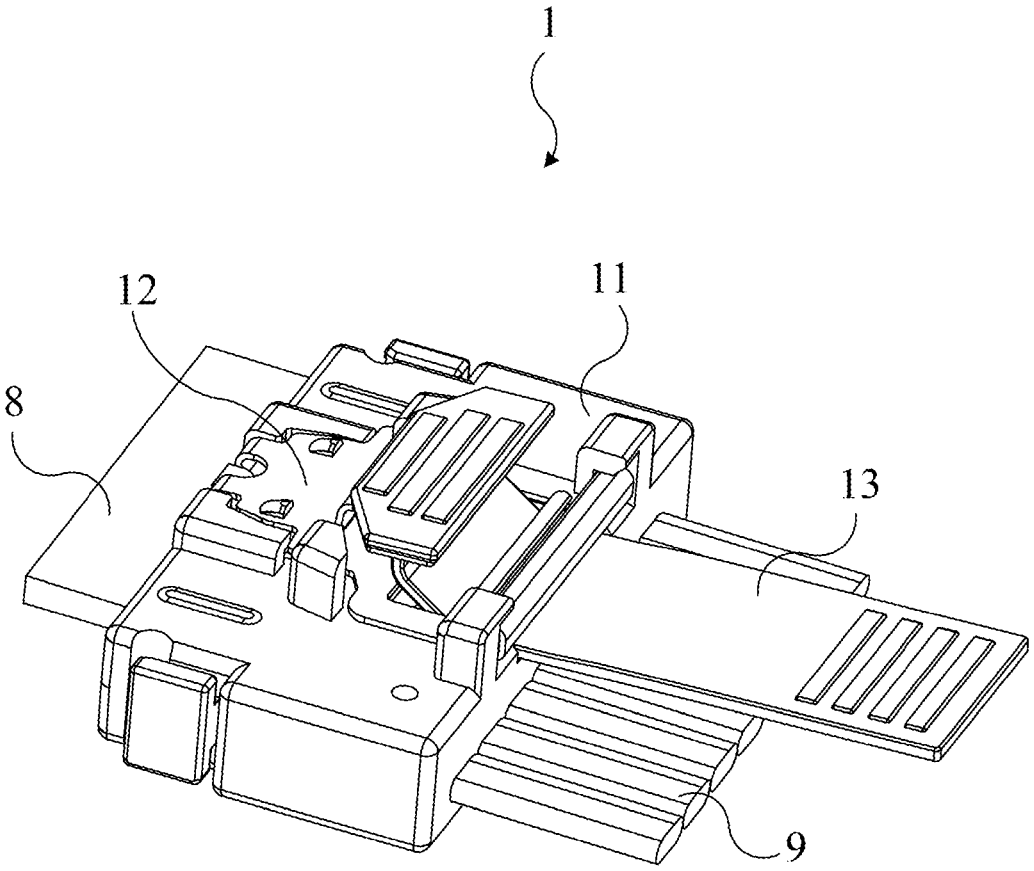
FIG. 1 is an assembly diagram illustrating a connector structure with pull tap according to an embodiment of the present invention.

For the sake of the advantages, spirits and features of the present invention can be understood more easily and clearly, the detailed descriptions and discussions will be made later by way of the embodiments and with reference of the diagrams. It is worth noting that these embodiments are merely representative embodiments of the present invention, wherein the specific methods, devices, conditions, materials and the like are not limited to the embodiments of the present invention or corresponding embodiments. Moreover, the devices in the figures are only used to express their corresponding positions and are not drawing according to their actual proportion.

In the description of the present invention, it is to be understood that the orientations or positional relationships of the terms "longitudinal, lateral, upper, lower, front, rear, left, right, top, bottom, inner, outer" and the like are based on the orientation or positional relationship shown in the drawings. It is merely for the convenience of the description of the present invention and the description of the present invention, and is not intended to indicate or imply that the device or component referred to has a specific orientation, is constructed and operated in a specific orientation, and therefore cannot be understood as limitations of the invention.

Unless specific stipulates and limitations, the term "installation, connection, assembly" should be understood in a broad sense in the description of the present invention, for example, it can be directly connected or indirectly connected through an intermediary. For the people of ordinary skill in the art, the specific meaning of the above-mentioned terms can be understood according to specific circumstances.

Figure 2:
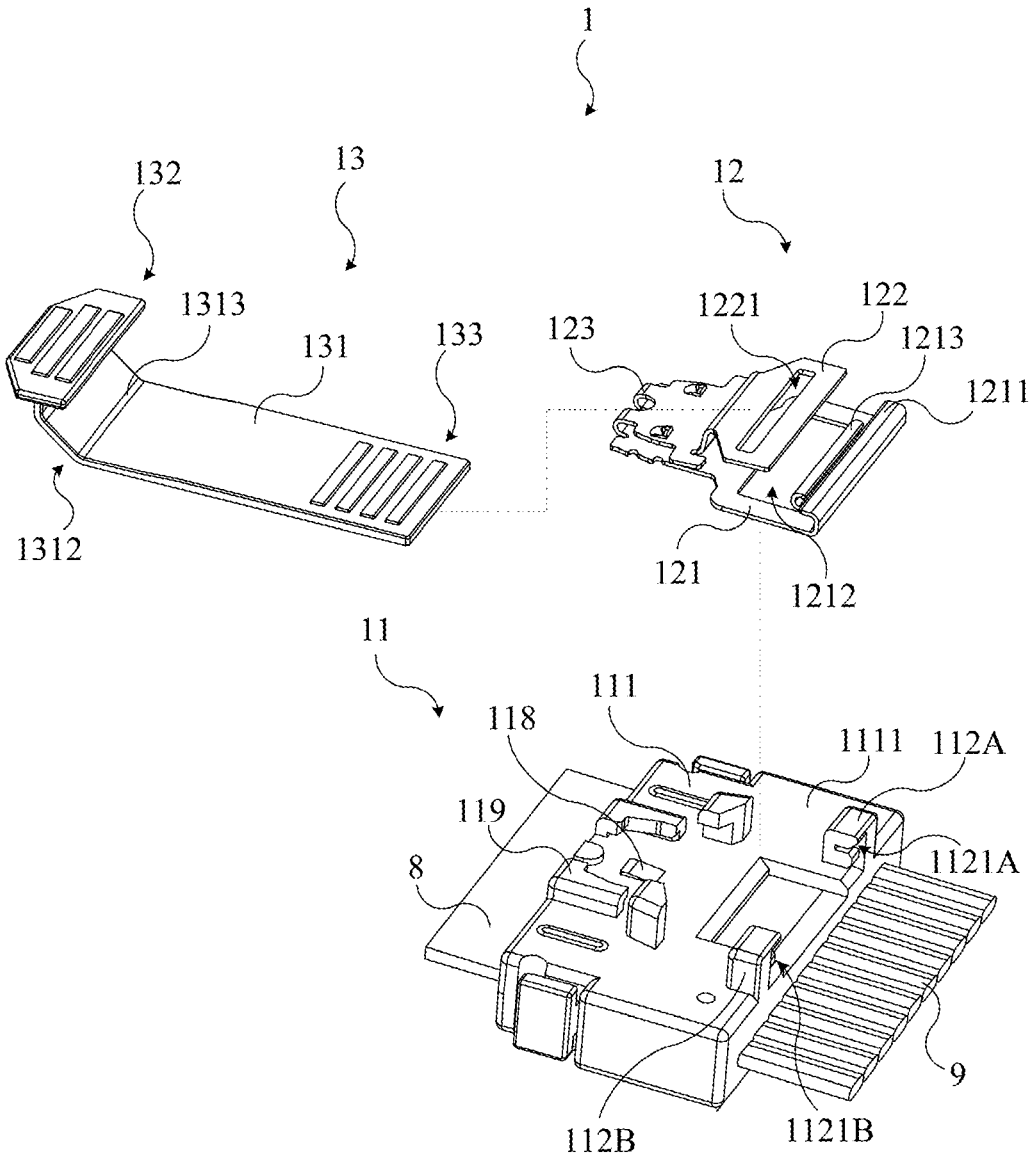
FIG. 2 is an exploded diagram illustrating the connector structure with pull tap in FIG. 1.

Please refer to FIG. 1 and FIG. 2. FIG. 1 is an assembly diagram illustrating a connector structure 1 with pull tap according to an embodiment of the present invention. FIG. 2 is an exploded diagram illustrating the connector structure 1 with pull tap in FIG. 1. In this embodiment, the connector structure 1 includes a plug 11, a latch 12 and a pull tap 13. The latch is configured on the plug 11, and the pull tap 13 is assembled on the latch 12. In practice, the plug 11 includes a main body 111, and the main body 111 has a containing space configured to contain a circuit board 8 and cables 9. A part of circuit board 8 is exposed to one side of the main body 111 to connect the socket matching up with the plug 11, and a part of cables 9 are exposed to the other side of the main body 111 corresponding to the circuit board 8. The main body 111 has a first plane surface 1111, and the plug 11 includes a bump structure 118 and a restriction structure 119 extending outward from the first plane surface 1111 and located at an end of the main body 111 close to the circuit board 8. The latch 12 includes a fixed arm 121 and a connecting end 123. The connecting end 123 is located at one end of the fixed arm 121. The fixed arm 121 includes hole (not shown in figure) close to the connecting end 123 and corresponding to the bump structure 118 of the plug 11. The shape of the latch 12 is corresponding to that of the restriction structure 119 of the plug 11. When the latch 12 is configured on the plug 11, the restriction structure 119 of the plug 11 limits the connecting end 123 of the latch 12 and the bump structure 118 embeds the hole of the latch, so that the latch 12 is connected to the first plane surface 1111 of the plug 11. In practice, the shapes of the bump structure 118, the restriction structure 119 and the hole corresponding to the bump structure 118 are not limited to the form of this specific embodiment, the components can also be other forms to dispose the connecting end 123 of the latch 12 on the first plane surface 1111 of the plug 11.

The latch 12 further includes an elastic arm 122 extending from the fixed arm 121 and hanging above the fixed arm 121. Furthermore, the elastic arm 122 can extend from the connecting end 123 of the latch 12 and be located at the other end of the latch 12 opposite to fixed arm 121. Therefore, when the latch 12 is configured on the plug 11, the fixed arm 121 and the connecting end 123 of the latch 12 are contacted and are fixed on the first plane surface 1111 of the plug 11, and the elastic arm 122 of the latch hangs above the fixed arm 121 and the first plane surface 1111.

In this embodiment, the plug 11 further includes two protruding structures, namely a first protruding structure 112A and a second protruding structure 112B. The first protruding structure 112A and the second protruding structure 112B are extended from the first plane surface 1111 of the main body 111 and include a first groove 1121A and a second groove 1121B respectively. The fixed arm 121 of the latch has an installing structure 1211 matching the first groove 1121A and the second groove 1121B. The first groove 1121A and the second groove 1121B are opposite to each other and configured at two opposite sides of the installing structure 1211 respectively. When the latch 12 is configured on the plug 11, the installing structure 1211 is embedded to the first groove 1121A and the second groove 1121B.

In practice, the first protruding structure 112A and the second protruding structure 112B extend from the first plane surface 1111 and are located at an end of the main body 111 close to the cables 9, and the installing structure 1211 is located the end of the fixed arm 121 away from the connecting end 123. The first groove 1121A, the second groove 1121B, and the installing structure 1211 may be mutually matched structures, and may be connected to each other in a snap-fit or embedded manner. Moreover, the first groove 1121A, the second groove 1121B, and the installing structure 1211 may also have shapes and sizes corresponding to each other. When the latch 12 is configured on the plug 11, the connecting end 123 of the latch 12 is connected to plug 11, and the installing structure 1211 of the fixed arm 121 is also connected to the first groove 1121A and the second groove 1121B of the first protruding structure 112A and the second protruding structure 112B, so that the latch 12 is connected to the plug 11. Moreover, the distance between the first protruding structure 112A and the second protruding structure 112B can be corresponding to the width of the latch 12. The shape and size of the first groove 1121A can be the same as those of the second groove 1121B, and the first groove 1121A and the second groove 1121B face the latch 12 respectively. Therefore, when the latch 12 is configured on the plug 11, the installing structure 1211 of the fixed arm 121 can be embedded to the first groove 1121A and the second groove 1121B at the same time. It should be noted that the shapes of the groove 1121 and the installing structure 1211 are not limited to that in FIG. 1 and FIG. 2, and the shapes can be changed according to the requirements of design. In practice, the number of the protruding structure is not limited to 2, and the number of the protruding structure also can be 1 or more than 3.

In this embodiment, the connector structure 1 of the present invention further includes a pull tap 13, and the fixed arm 121 of the latch 12 includes an opening 1212. The pull tap 13 is assembled on the latch 12. The pull tap 13 includes a tap body 131 and a first end 132 located at one end of the tap body 131. The pull tap 131 passes through the opening 1212 of the fixed arm 121, and the elastic arm 122 of the latch 12 is arranged on the first end 132 to fix the first end 132 on the elastic arm 122. In practice, the opening 1212 of the fixed arm 121 may be adjacent to the installing structure 1211. The elastic arm 122 and the first end 132 of the pull tap 13 can be connected in the arrangement manner, but the connection manner is not limited to it herein. The tap body 131 of the pull tap 13 can be extended from the first end 132 toward the direction of the cables 9. When the pull tap 13 is assembled on the latch 12, the tap body 131 passes through the opening 1212 of the fixed arm 121 and protrudes in the direction of the cables 9. Therefore, the pull tap 13 is limited at the opening 1212 of the fixed arm 121 and can be pulled toward the direction of the cables 9.

Figure 3:
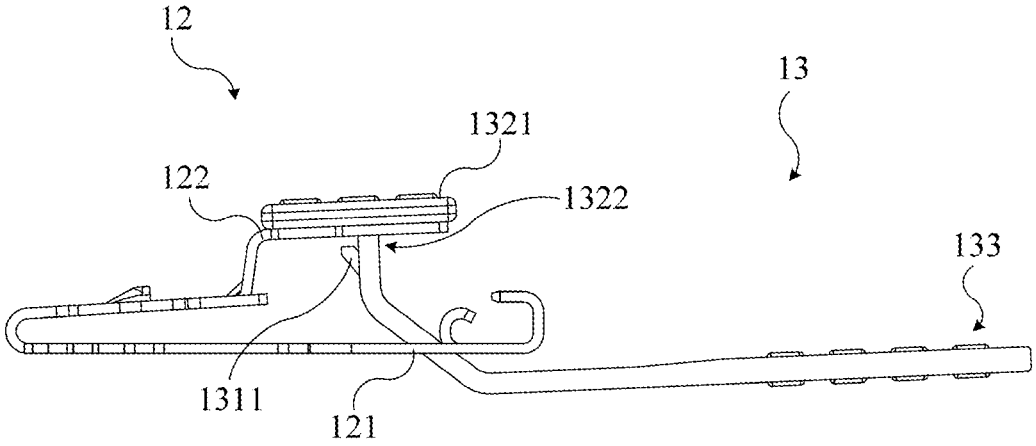
FIG. 3 is a side view diagram illustrating the latch and the pull tap in FIG. 1.

Please refer to FIG. 1, FIG. 2 and FIG. 3. FIG. 3 is a side view diagram illustrating the latch 12 and the pull tap 13 in FIG. 1. In this embodiment, the elastic arm 122 includes a fixed hole 1221. The first end 132 of the tap body 131 includes a tap head 1321 and a neck portion 1322. The tap body 131 includes a second end 133 opposite to the first end 132 and a flexible structure 1311. The neck portion 1322 is located at one end of the first end 132, and the tap head 1321 is connected to the neck portion 1322. The size of the tap head 1321 is larger than that of the fixed hole 1221, and the neck portion 1322 is located between the tap head 1321 and the flexible structure 1311. The sizes of the tap body 131, neck portion 1322 and the second end 133 can be corresponding to that of the fixed hole 1221, so that the tap body 131, neck portion 1322 and the second end 133 can pass through the fixed hole 1221. The flexible structure 1311 can be formed by stamping and protrudes from the tap body 131. When the pull tap 13 is assembled on the latch 12, the second end 133 of the tap body 131 passes through the fixed hole 1221 of the elastic arm 122 toward the direction of the fixed arm 121 of the latch 12. Then, when the tap body 131 passes through the fixed hole 1221 continuously to make the flexible structure 1311 enter the fixed hole 1221, the flexible structure 1311 is pressed back to the tap body 131 due to the restriction of the fixed hole 1221. Furthermore, when the tap body 131 passes through the fixed hole 1221 continuously to make the neck portion 1322 enter the fixed hole 1221, the flexible structure 1311 rebounds to the original position, to limit the elastic arm 122 between the tap head 1321 and the flexible structure 1311. Therefore, the pull tap 13 can be assembled and connected to the latch 12.

Moreover, the second end 133 of the tap body 131 can pass through the opening 1212 of the fixed arm 121 after passing through the fixed hole 1221 of the elastic arm 122. Therefore, when the pull tap 13 is assembled on the latch 12, the pull tap 13 can pass through the fixed hole 1221 of the elastic arm 122 to connect the tap head 1321 and the elastic arm 122 and pass through the opening 1212 of the fixed arm 121 for pulling.

In this embodiment, the fixed arm 121 of the latch 12 further includes a guiding structure 1213, and the guiding structure 1213 is located above the opening 1212 of the fixed arm 121. In practice, the guiding structure 1213 may be integrally formed on the latch 12. The guiding structure 1213 can be located between the opening 1212 of the fixed arm 121 and the installing structure 1211. When the pull tap 13 is assembled in the latch 12 and pulled toward the direction of cables 9, the tap body 131 contacts the guiding structure 1213. Then, the tap body 131 passes through the opening 1212 of the fixes arm 121. At this time, the pull tap 13 moves while contacting the guiding structure 1213 continuously. The material of the latch 12 is usually metal. Therefore, when the pull tap 13 moves back and forth in several times, the guide structure 1213 is not easily to cause abrasion, thereby improving the durability of the connector and reducing the costs.

Figure 4:
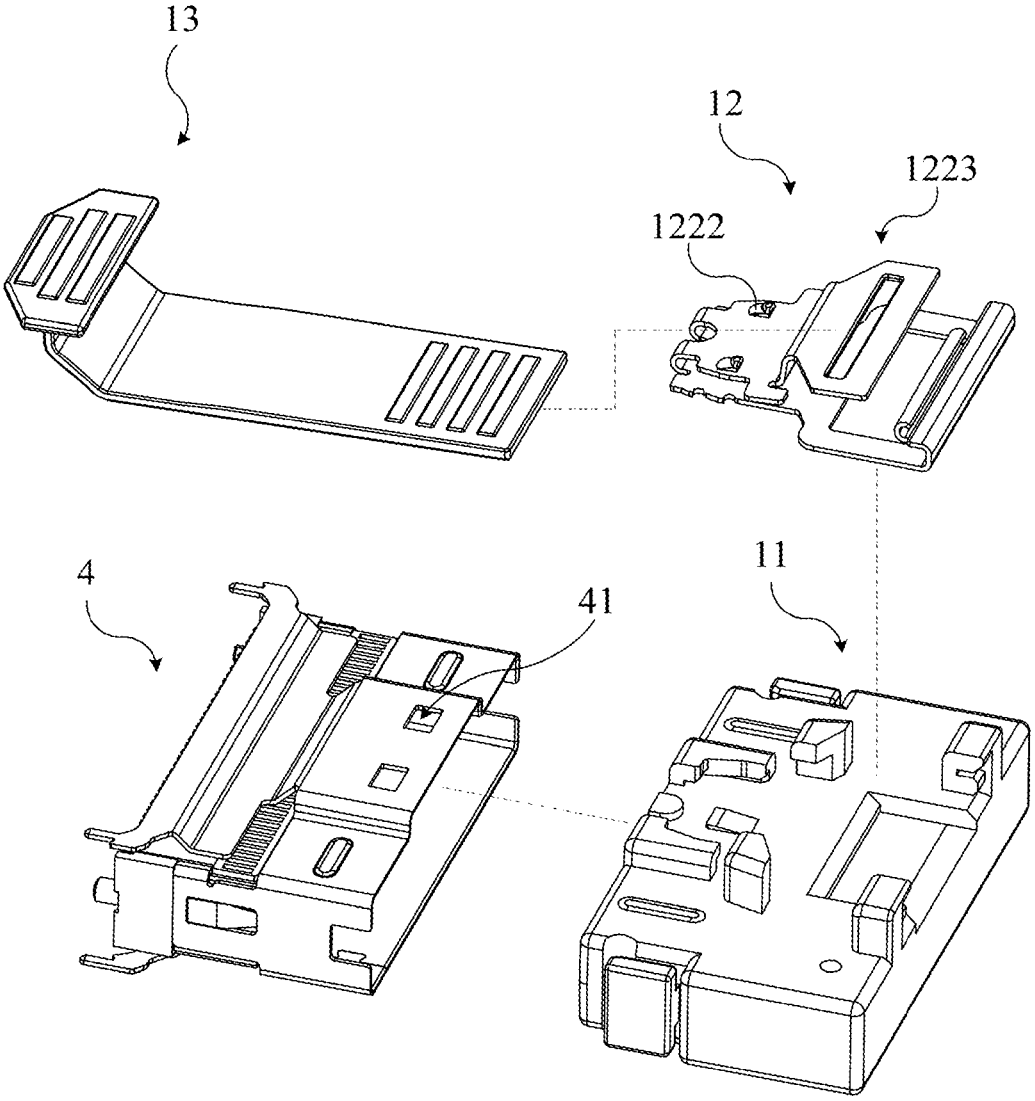
FIG. 4 is an exploded diagram illustrating the connector structure with pull tap and a socket according to the embodiment of FIG. 1.

Please refer to FIG. 1, FIG. 3 and FIG. 4. FIG. 4 is an exploded diagram illustrating the connector structure 1 with a pull tap and a socket 4 according to the embodiment of FIG. 1. In this embodiment, the tap body 131 has a bend portion 1312, and the elastic arm 122 of the latch 12 has a press portion 1223. The bend portion 1312 has a bending surface 1313. In practice, the bend portion 1312 of the tap body 131 can be located between the flexible structure 1311 and the second end 133, and the shape of the bend portion 1312 can be changed according to the requirements of design. The pull tap 13 contacts the guiding structure 1213 continuously when the pull tap 13 is assembled on the latch 12 and the second end 133 of the pull tap 13 is pulled, and the tap head 1321 of the pull tap 13 moves downward with the bending surface 1313. Therefore, the tap head 1321 attaches and presses the press portion 1223 of the elastic arm 122 to drive the elastic arm 122 move in downward direction. The bend portion 1312 and the bending surface 1313 can reduce the lateral pressure caused by the guiding structure 1213 when the pull tap 13 is pulled, so that the guiding structure 1213 is not easily to be damaged, thereby improving the durability of the connector and reducing the costs.

In this embodiment, the elastic arm 122 of the latch 12 includes a lock structure 1222, and the socket 4 matching up with the plug 11 includes a lock opening 41. The lock structure 1222 is corresponding to the lock opening 41 of the socket 4. When the connector structure 1 is connected to the socket 4, the lock structure 1222 is embedded to the lock opening 41. In one embodiment, the plug 11 is connected to the socket 4 and the pull tap 13 is assembled on the latch 12. When the second end 133 is pulled, the pull tap 13 drives the tap head 1321 to move downward to press the press portion 1223 of the elastic arm 122, so that the press portion 1223 and the elastic arm 122 move downward to separate the lock structure 1222 from the lock opening 41 of the socket, thereby separating the plug 11 from the socket 4.

Figure 5:
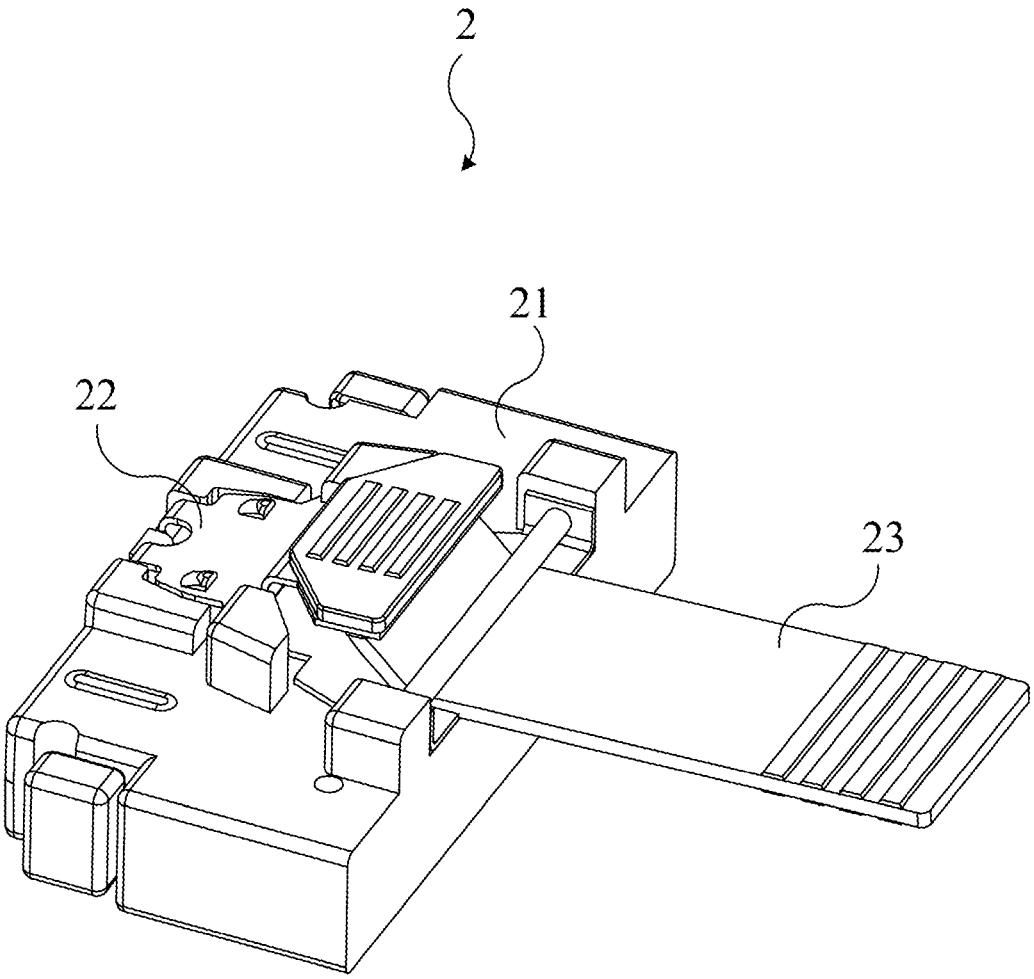
FIG. 5 is an assembly diagram illustrating the connector structure with pull tap according to an embodiment of the present invention.
Figure 6:
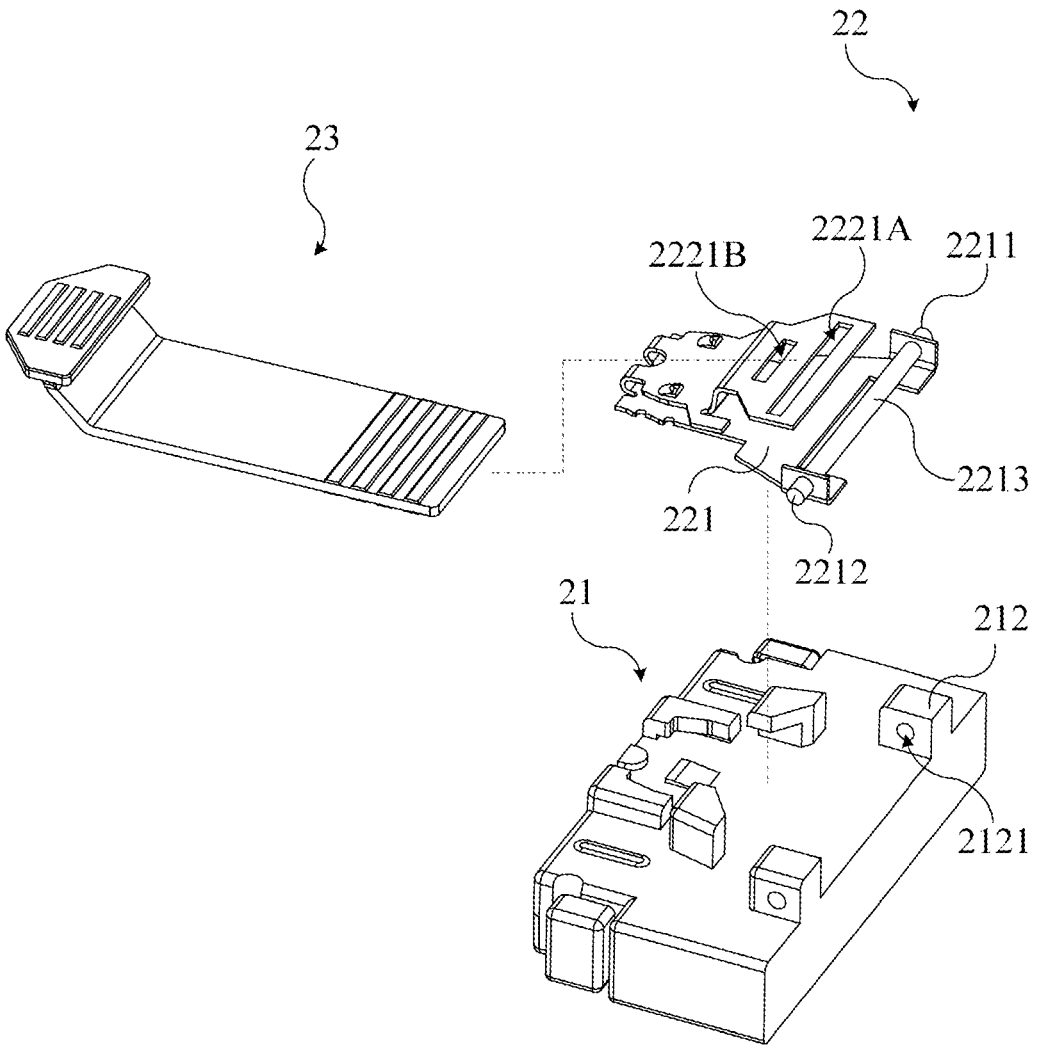
FIG. 6 is an exploded diagram illustrating the connector structure with pull tap in FIG. 5.
Figure 7:
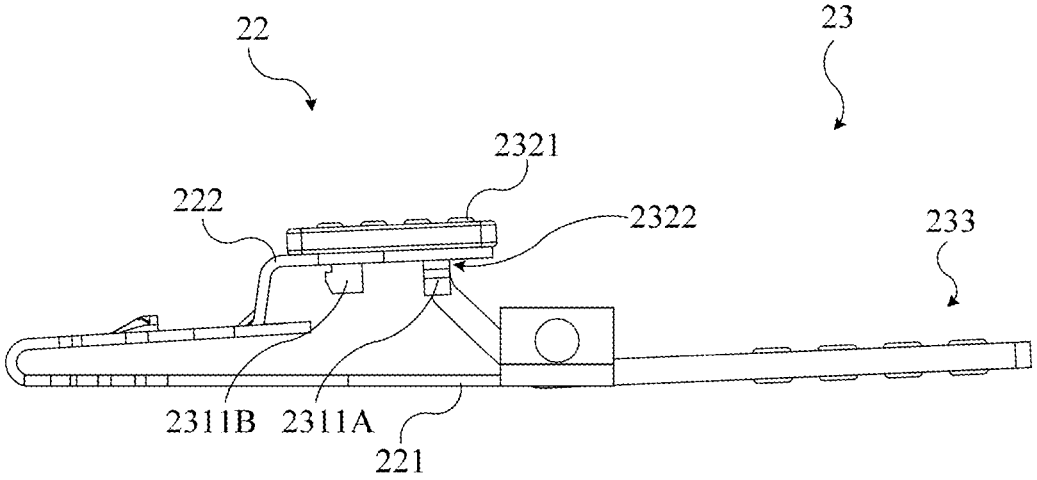
FIG. 7 is a side view diagram illustrating the latch and the pull tap in FIG. 5.

In addition to the aforementioned embodiment, the connector structure with pull tap of the present invention also can be in other forms. Please refer to FIG. 5, FIG. 6 and FIG. 7. FIG. 5 is an assembly diagram illustrating the connector structure 2 with pull tap according to an embodiment of the present invention. FIG. 6 is an exploded diagram illustrating the connector structure 2 with pull tap in FIG. 5. FIG. 7 is a side view diagram illustrating the latch 22 and the pull tap 23 in FIG. 5. The difference between this embodiment and the aforementioned embodiment is that the fixed arm 221 of the latch 22 includes a column structure 2211, and the elastic arm 222 includes a first fixed hole 2221A and a second fixed hole 2221B. The pull tap 23 includes a first flexible structure 2311A and a second flexible structure 2311B. The column structure 2211 includes the installing structure 2212 and the guiding structure 2213. The first flexible structure 2311A is located at the tap body 231 of the pull tap 23, and the second flexible structure 2311B is connected to the tap head 2321. Two ends of the column structure 2211 are the installing structure 2212, and the main body of the column structure 2211 is the guiding structure. In this embodiment, the groove 2121 of the protruding structure 212 of the plug 21 is a circular groove. When the latch 22 is assembled on the plug 21, the connecting end of the latch 12 is fixed on the plug 21, and then the column structure 2211 passes through the two grooves 2121 of the protruding structure 212 to fix the fixed arm 221 of the latch 22 on the protruding structure 212.

When the pull tap 23 is assembled on the latch 22, the second end 233 of the tap body 231 passes through the first fixed hole 2221A of the elastic arm 222 toward the direction of the fixed arm 221 of the latch 22. Then, when the tap body 231 passes through the first fixed hole 2221A continuously to make the first flexible structure 2311 enter the first fixed hole 2221A, the first flexible structure 2311A is pressed back to the tap body 231 due to the restriction of the first fixed hole 2221A. Furthermore, when the first flexible structure 2311A passes through the first fixed hole 2221A, the first flexible structure 2311A rebounds to the original position, to limit the elastic arm 222 between the tap head 2321 and the first flexible structure 2311A. Moreover, the second flexible structure 2311B also passes through the second fixed hole 2221B while the first flexible structure 2311A passes through the first fixed hole 2221A. The second flexible structure 2311B includes a hook. When the second flexible structure 2311B also passes through the second fixed hole 2221B, the hook of the second flexible structure 2311B limits the elastic arm 222 between the tap head 2321 and the hook. Therefore, the pull tap 23 can be assembled on the latch 22.

Figure 8:
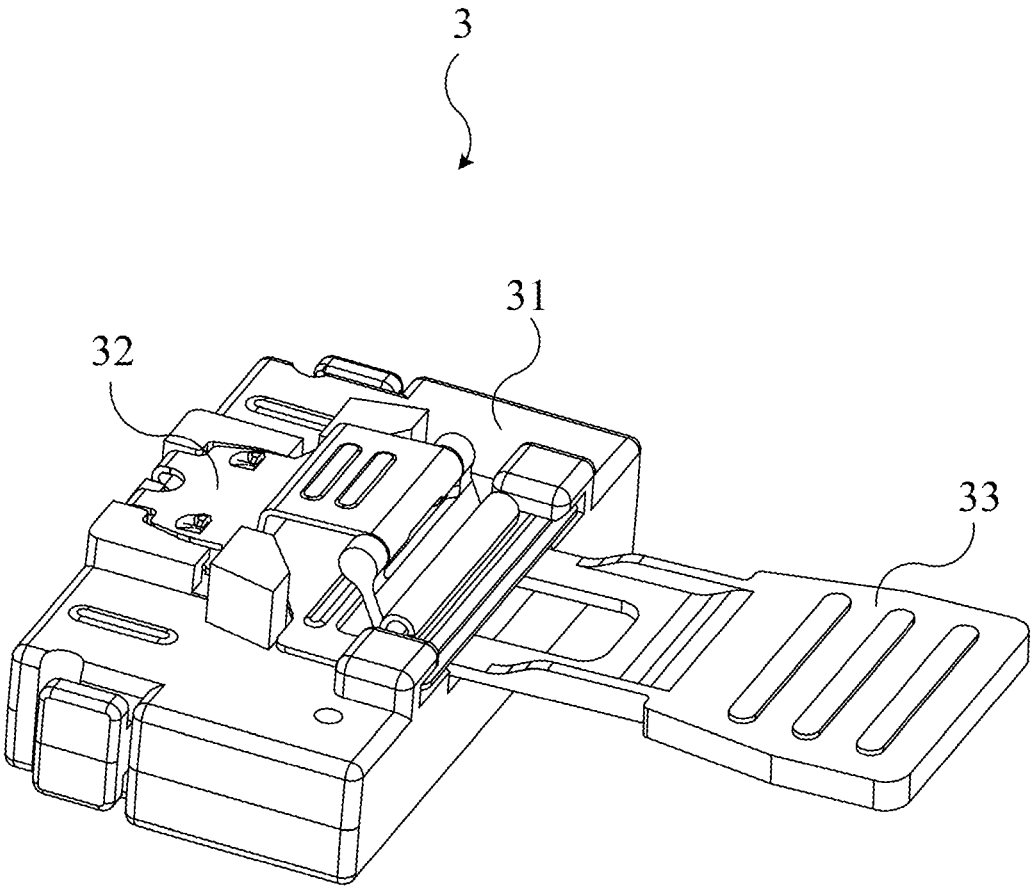
FIG. 8 is an assembly diagram illustrating the connector structure with pull tap according to another one embodiment of the present invention.
Figure 9:
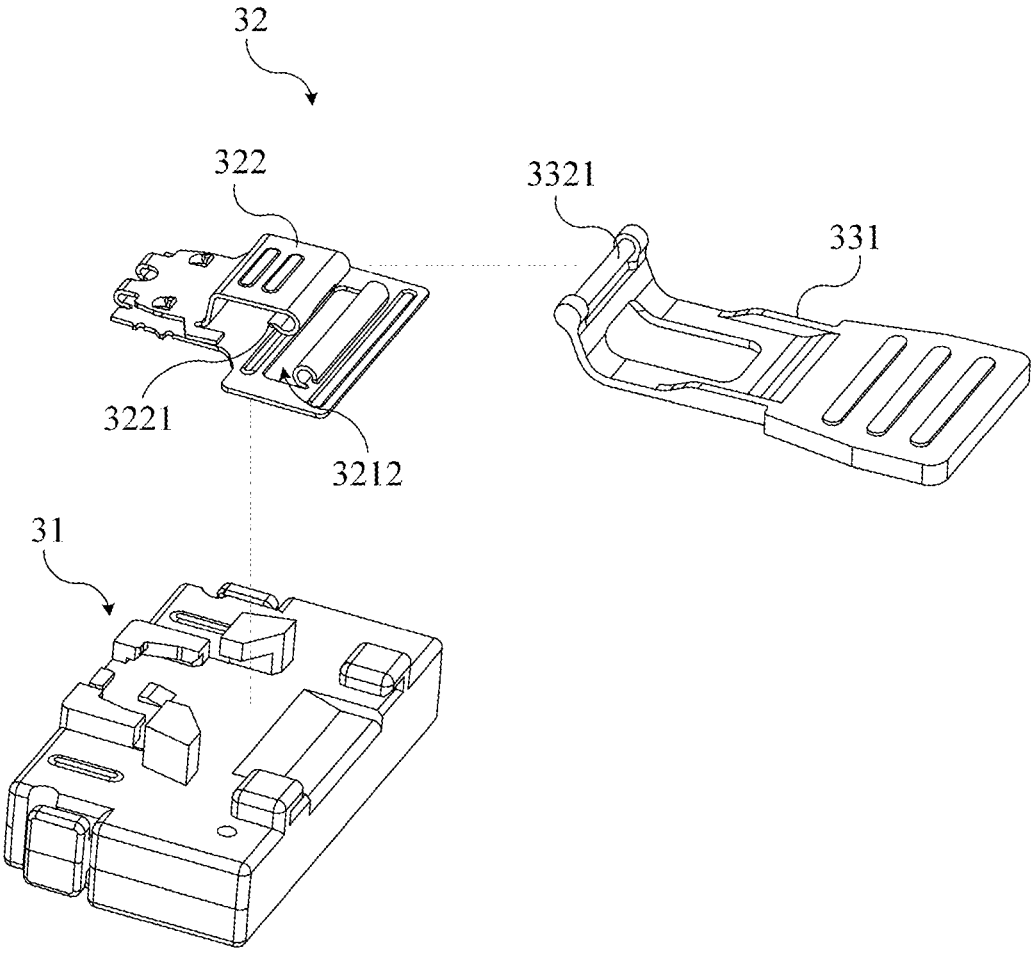
FIG. 9 is an exploded diagram illustrating the connector structure with pull tap in FIG. 8.
Figure 10:
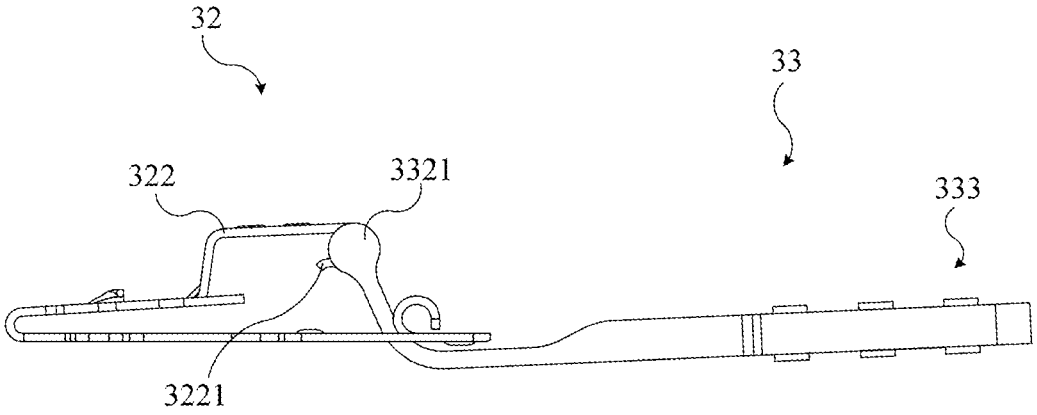
FIG. 10 is a side view diagram illustrating the latch and the pull tap in FIG. 8.

Please refer to FIG. 8, FIG. 9 and FIG. 10. FIG. 8 is an assembly diagram illustrating the connector structure 3 with pull tap according to another one embodiment of the present invention. FIG. 9 is an exploded diagram illustrating the connector structure 3 with pull tap in FIG. 8. FIG. 10 is a side view diagram illustrating the latch 32 and the pull tap 33 in FIG. 8. The difference between this embodiment and the aforementioned embodiment is that the elastic arm 322 of the latch 32 includes a hook structure 3221, and the first end 332 of the pull tap 32 includes a tap head 3321 matching up with the hook structure 3221. In practice, the tap head 3321 of the tap body 331 can be hooked to the hook structure 3221. When the pull tap 33 is assembled on the latch 32, the first end 332 of the pull tap 33 passes through the opening 3212 of the foxed arm 321 in the direction of the elastic arm 322 of the latch 32, and then the tap head 3321 of the first end 322 hooks the hook structure 3221 of the elastic arm 322.

Compared with the prior art, the connector structure with pull tap of the present invention strengthens the structures between the latch and the plug through the fixed arm of the latch and the protruding structure of the plug, so that the latch is not easily to shake or bend, thereby increasing efficiency and durability. Moreover, the connector structure of the present invention guides the moving direction of the pull tap by the guiding structure of the latch instead of the connector body, to avoid the abrasion of the connector body caused by multiple pulls of the pull tap, thereby reducing costs.

With the examples and explanations mentioned above, the features and spirits of the invention are hopefully well described. More importantly, the present invention is not limited to the embodiment described herein. Those skilled in the art will readily observe that numerous modifications and alterations of the device may be made while retaining the teachings of the invention. Accordingly, the above disclosure should be construed as limited only by the metes and bounds of the appended claims.

What is claimed is:

1. A connector structure with pull tap, comprising:

a plug, comprising a main body and a protruding structure, the protruding structure extending outward from the main body and having a groove;

a latch, configured on the plug, the latch further comprising:

a fixed arm, having an installing structure matching the groove and an opening, the installing structure being pivotally connected to the groove of the protruding structure; and an elastic arm, extending from the fixed arm and hanging above the fixed arm; and a pull tap, assembled on the latch, the pull tap comprising a tap body and a first end located at one end of the tap body, the pull tap passing through the opening of the fixed arm and the elastic arm arranging on the first end to fix the first end on the elastic arm.

2. The connector structure with pull tap of claim 1, wherein the protruding structure comprises a first protruding structure and a second protruding structure, the first protruding structure and the second protruding structure comprise a first groove and a second groove respectively, the first groove and the second groove are opposite to each other and configured at two opposite sides of the installing structure respectively, and the installing structure is embedded to the first groove and the second groove when the latch is configured on the plug.

3. The connector structure of claim 1, wherein the elastic arm comprises a fixed hole, the first end of the pull tap comprises a tap head and a neck portion, and the tap body comprises a flexible structure, the size of the tap head is larger than that of the fixed hole, and the neck portion is located between the tap head and the flexible structure, the fixed hole is arranged on the neck portion and the tap head and the flexible structure are located at two opposite sides of the elastic arm respectively after the pull tap is assembled on the latch.

4. The connector structure of claim 3, wherein the tap body comprises a second end opposite to the first end, when the pull tap is assembled on the latch, the second end of the tap body passes through the fixed hole of the elastic arm and the opening of the fixed arm in sequence to attach the tap head on one side of the elastic arm.

5. The connector structure of claim 1, wherein the elastic arm comprises a first fixed hole and a second fixed hole, the first end of the tap body comprises a tap head and a neck portion, the tap body comprises a first flexible structure and the tap head comprises a second flexible structure, the size of the tap head is greater than that of the fixed hole, and the neck portion is located between the tap head and the flexible structure, when the pull tap is assembled on the latch, the first fixed hole is arranged on the neck portion, the second fixed hole is arranged on the second flexible structure, and the tap head and the first flexible structure are located at two opposite sides of the installing structure respectively.

6. The connector structure of claim 1, wherein the elastic arm comprises a hook structure, and the first end of the tap body comprises a tap head matching the hook structure, when the pull tap is assembled on the latch, the tap head passes through the opening of the fixed arm and hooks the hook structure.

7. The connector structure of claim 1, wherein the fixed arm comprises a guiding structure, the guiding structure is located above the opening of the fixed arm.

8. The connector structure of claim 7, wherein the elastic arm of the latch comprises a lock structure, the lock structure is configured to joint a lock opening of a socket matching the lock structure.

9. The connector structure of claim 8, wherein the elastic arm of the latch has a press portion configured to be pressed, when the press portion is pressed, the elastic arm is deformed to separate the lock structure from the lock opening.

10. The connector structure of claim 9, wherein the tap body comprises a second end opposite to the first end and has a bend portion, the bend portion has a bending surface, when the second end is pulled, the bend portion contacts the guiding structure and moves along the bending surface to press the press portion of the elastic arm by the first end of the pull tap.

* * * * *